US005803003A

United States Patent [19]

Vickers

[11] Patent Number: 5,803,003

[45] Date of Patent: Sep. 8, 1998

[54] ROTARY BOAT LIFT

[75] Inventor: Robert V. Vickers, Chagrin Falls, Ohio

[73] Assignee: The Louis Berkman Company, Steubenville, Ohio

[21] Appl. No.: 775,872

[22] Filed: Jan. 2, 1997

[51] Int. Cl.[6] ..... B63C 1/00

[52] U.S. Cl. ..... 114/44; 405/3

[58] Field of Search ..... 405/3; 114/44, 114/45, 374; 187/406, 410, 409

[56] References Cited

U.S. PATENT DOCUMENTS

| | | | |
|---|---|---|---|
| 2,888,152 | 5/1959 | Sugg . | |
| 3,088,545 | 5/1963 | Meyer | 187/410 |
| 4,432,664 | 2/1984 | Baldyga . | |
| 4,482,268 | 11/1984 | Stevenson et al. . | |
| 4,678,366 | 7/1987 | Williamson . | |
| 4,714,375 | 12/1987 | Stevenson et al. . | |
| 4,983,067 | 1/1991 | Montgomery . | |
| 5,090,842 | 2/1992 | Montgomery . | |
| 5,199,533 | 4/1993 | Wilke | 187/409 |

FOREIGN PATENT DOCUMENTS 625521 8/1927 Germany .

*Primary Examiner*—Sherman Basinger
*Attorney, Agent, or Firm*—Vickers, Daniels & Young

[57] ABSTRACT

Boat lift apparatus comprises vertically oriented upper and lower box beam track members mounted adjacent a dock for the upper track member to extend above the deck of the dock. The upper track member is rotatable relative to the lower track member, and the two track members support a boat cradle for vertical displacement therealong between a lower position in which the cradle is partially submerged in water for loading and unloading a boat thereon and an upper position in which the cradle is on the upper track member and pivotal therewith to overlie the deck. The cradle is provided with upper and lower bearing arrangements by which the cradle is supported for vertical displacement along the track members, and the lower bearing arrangement is comprised of opposed pairs of bearing blocks having planar surfaces for sliding engagement with the track members, and the upper bearing arrangement is comprised of opposed pairs of bearing rolls in rolling engagement with the track members.

34 Claims, 10 Drawing Sheets

ROTARY BOAT LIFT

BACKGROUND OF THE INVENTION

This invention relates to the art of boat lifting apparatus and, more particularly, to boat lifting apparatus for elevating a boat from water to a location above an adjacent dock and then turning the boat to overlie the dock.

Boat lifting apparatus mounted on the side of a dock for elevating a boat from a location in water adjacent the dock to a location overlying the dock is well known, and one such apparatus for the latter purpose is shown in U.S. Pat. No. 4,983,067 to Montgomery, which is incorporated by reference. In Montgomery, around tubular support post or track extends vertically adjacent a dock and is mounted thereon by a spacer or stand-off plate. The track has a portion extending above the dock and a portion extending downwardly into the water and anchored either in the water bed or to vertical piles of the dock. A boat cradle is mounted on the track for vertical displacement relative thereto between a lower position in which a portion of the cradle is submerged for the loading or unloading of a boat therefrom and an upper position in which the cradle is located above the deck or upper surface of the dock. In the latter position, the cradle is adapted to be rotated relative to the track to a position overlying the deck to facilitate the loading or unloading of a boat relative to the cradle. In Montgomery, the cradle is supported for axial and rotational displacement relative to the track by upper and lower axially slotted bearing sleeves mounted on the cradle and extending about the outer periphery of the track. The stand-off plate terminates at the level of the deck of the dock, and the slots in the bearing sleeves receive the stand-off plate during elevating and lowering of the cradle relative to the deck. When the cradle is elevated above the deck and thus above the upper end of the stand-off plate, the cradle is free to rotate about the track for positioning the cradle inwardly over the dock. Elevating and lowering of the cradle is achieved through the manipulation of a winch which is mounted on the upper end of the track.

In other boat lifting apparatus of the type described in Montgomery, the lift cradle is supported for displacement relative to a vertical track or post by axially spaced apart pairs of members allowing the support cradle to slide along the vertical support post, these sliding members being in the form of bearing rolls or wheels interengaging with diametrically opposite sides of the track or post respectively at lower and upper ends of the cradle. Further in accordance with such prior art, the portion of the track extending above the dock is rotatable relative to the lower track portion, and the cradle is rotatable with the upper portion for selectively orienting a boat on the cradle to overlie the dock or water.

The manner in which bearing blocks and bearing rolls have been used heretofore with respect to supporting the lifting and lowering of a boat cradle and a boat thereon provides both advantages and disadvantages from the standpoint of the ease of and the efficiency with which such lifting and lowering can be achieved. The areas of facial engagement of bearing blocks affect the ease with which the cradle can be elevated and lowered relative to the track, especially when the cradle is loaded and forces resisting sliding are imposed transverse to the track and bearing blocks in diametrically opposite directions at axially spaced apart locations. In contrast, bearing rolls or wheels advantageously minimize frictional interengagement between the track and bearings making it easier to elevate and lower the cradle relative to the track. However, bearing rolls or wheels tend to freeze relative to their axles, especially when moved into and out of the water as is necessary when the bearings are at the lower end of the cradle. Freezing of bearing rolls, which can be caused by many factors, such as contaminants in the water, is particularly prevalent in a salt water environment. The affects of alternate exposure to salt water and then atmosphere corrode the axles and/or bearings on the bearing rolls which rotate with respect to each other during vertical movement of the cradle. The corrosion increases friction and cause the bearing rolls to freeze into a fixed, non-operative position. Thus, bearing rolls on the lower end of the cradle often become inoperative and render the lift unit useless. Since these lifts are low cost items it is often the practice to replace the unit instead of investigating and repairing the defect. Such freezing of the rolls results in the bearing rolls being forced to slide on the track which accordingly negates the advantage of rolling contact insofar as ease of movement of the cradle is concerned. Moreover, sliding of the bearing rolls or wheels which are generally made of a polymeric material results in a loss in the circular contour thereof and thus increased difficulty in connection with displacement of the cradle relative to the track. If the rolls remain frozen, they are in effect the same as bearing blocks in sliding engagement with the track. If the rolls are freed for rotation, the out-of-round contour interferes with the desired rolling engagement. Still further, the rolling contact of such bearing rolls with the track does not wipe the latter, whereby there is a tendency for the buildup of deposits on the track which also interfere with the smoothness of rolling contact and thus the ease with which the cradle can be elevated and lowered. All of the foregoing problems and/or disadvantageous are inclined to progressively increase during the life of the boat lifting device making the operation thereof progressively more difficult.

SUMMARY OF THE INVENTION

Boat lifting apparatus is provided in accordance with the present invention which advantageously optimizes the ease with which a boat cradle and a boat thereon can be elevated and lowered relative to a dock and water therebelow. More particularly in this respect, a boat lifting device according to the present invention comprises bearing blocks or pads at the lower end of the cradle which is submerged in water during each cycle of operation of the lifting device, and bearing rolls or wheels at the upper end of the cradle which is not submerged in the water and which moves along a portion of the track which is out of the water and thus less inclined to accumulate deposits of the character which interfere with easy displacement of the cradle along the track. Accordingly, the ease of elevating and lowering the cradle relation to the track is optimized with respect to the longevity of operation with such ease. In this respect, the advantages of each of the block and roll type bearings are realized while the disadvantages thereof are minimized.

Preferably, the track is tubular and rectangular in cross section, and the pads and bearing rolls are in opposed pairs which engage opposed parallel planar surfaces of the track in supporting displacement of the cradle in opposite directions along the track. The track is preferably constructed to provide a lower portion, anchored to the dock and/or underlying support structure therefor, and a coaxial upper portion which is rotatable relative to the lower portion to facilitate swinging movement of the cradle laterally inwardly and outwardly of the edge of the dock on which the lifting apparatus is mounted. Such rotational interengagement between the upper and lower track portions is achieved through the use of roller and/or sleeve bearing arrangements which optimize structural integrity and, at the same time, promote ease of operation of the apparatus and protection of the component parts thereof from exposure to and the effects of water and contaminants therein.

In accordance with another aspect of the invention, the upper and lower portions of a rectangular track are interengaged in a manner which facilitates obtaining a desired orientation thereof relative to one another when the cradle is dispose on the one hand over the dock and on the other hand outwardly over the edge thereof. In particular in this respect, relative displacement between the upper and lower track portions which facilitates swinging the cradle inwardly and outwardly of a dock edge necessitates alignment of the planar walls of the upper and lower track portions to facilitate displacement of the cradle upwardly and downwardly therealong. Often it is difficult to obtain and maintain the necessary alignment simply by swinging the cradle and relying on visual alignment, whereby considerable advantage is derived from providing for the upper and lower track portions to interengage in a manner whereby a person turning the cradle and upper portion has a "feel" for when the parts are appropriately aligned. Such alignment advantageously prevents interference between the cradle and track members during displacement of the cradle therealong and across the juncture between the upper and lower track portions. Such interference can and is likely to cause damage to the bearing components supporting the cradle for displacement along the track members.

It is accordingly an outstanding object of the present invention to provide an improved boat lift device for elevating and lowering a boat relative to a dock and water therebelow.

Another object is the provision of a boat lift comprising a cradle and track interengaged by bearing components and a bearing component arrangement which optimizes the ease of displacing the cradle relative to the track while promoting retention of the interengaging relationships between the bearing components and track by which such ease is obtained.

A further object is the provision of a boat lift of the foregoing character which promotes the useful life of the component parts thereof by a structural selection and orientation of the parts which optimizes the advantages thereof relative to the environment of use.

Yet a further object is the provision of a boat lift of the foregoing character in which the component parts are structured and structurally interrelated so as to optimize protection thereof against damage resulting from exposure to buildup of deposits of contaminants thereon and/or misalignment between component parts during operation of the lifting apparatus.

BRIEF DESCRIPTION OF THE DRAWING

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
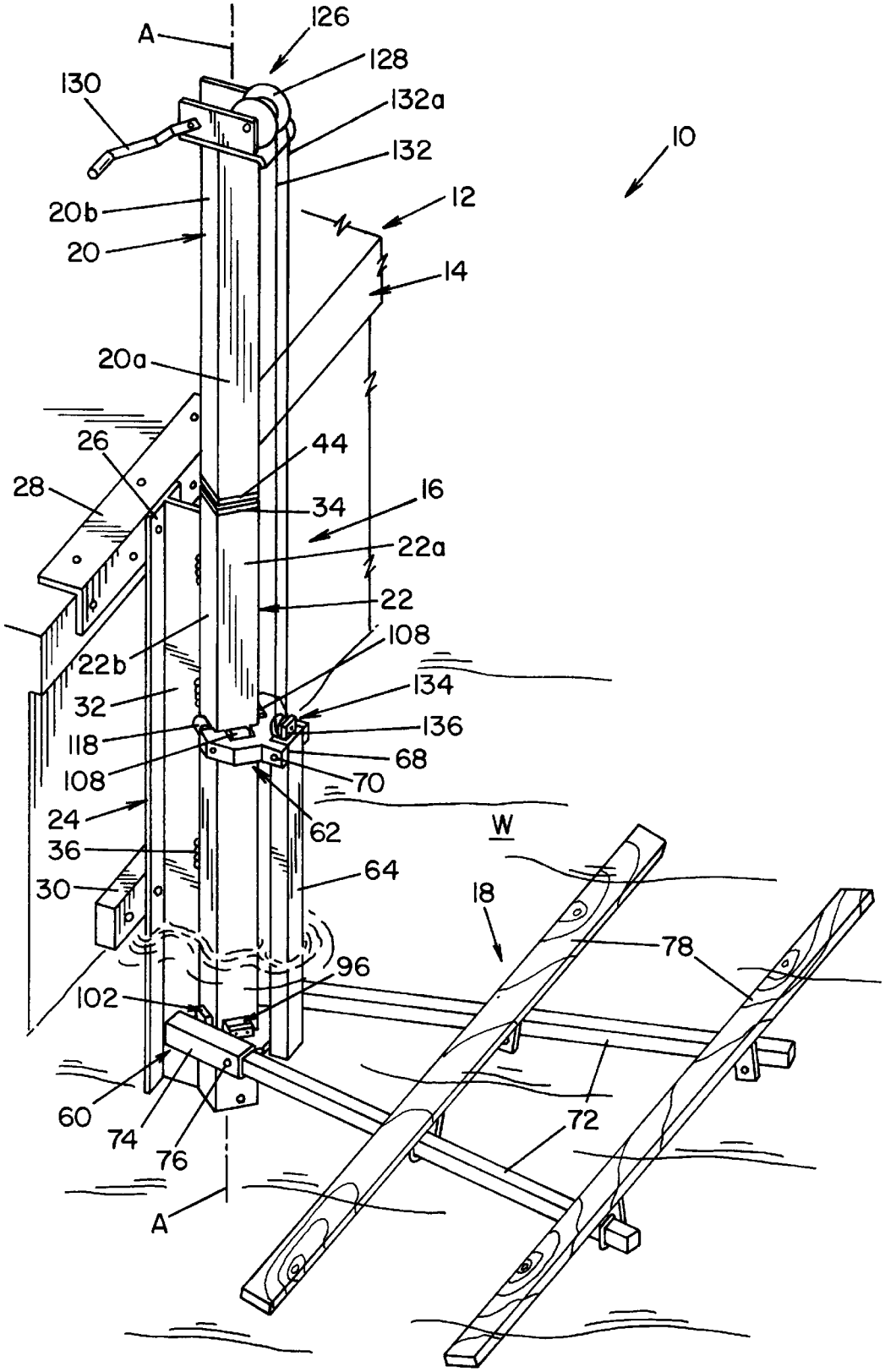
FIG. 1 is a perspective view of a boat lift device in accordance with the present invention mounted adjacent a dock.
Figure 2:
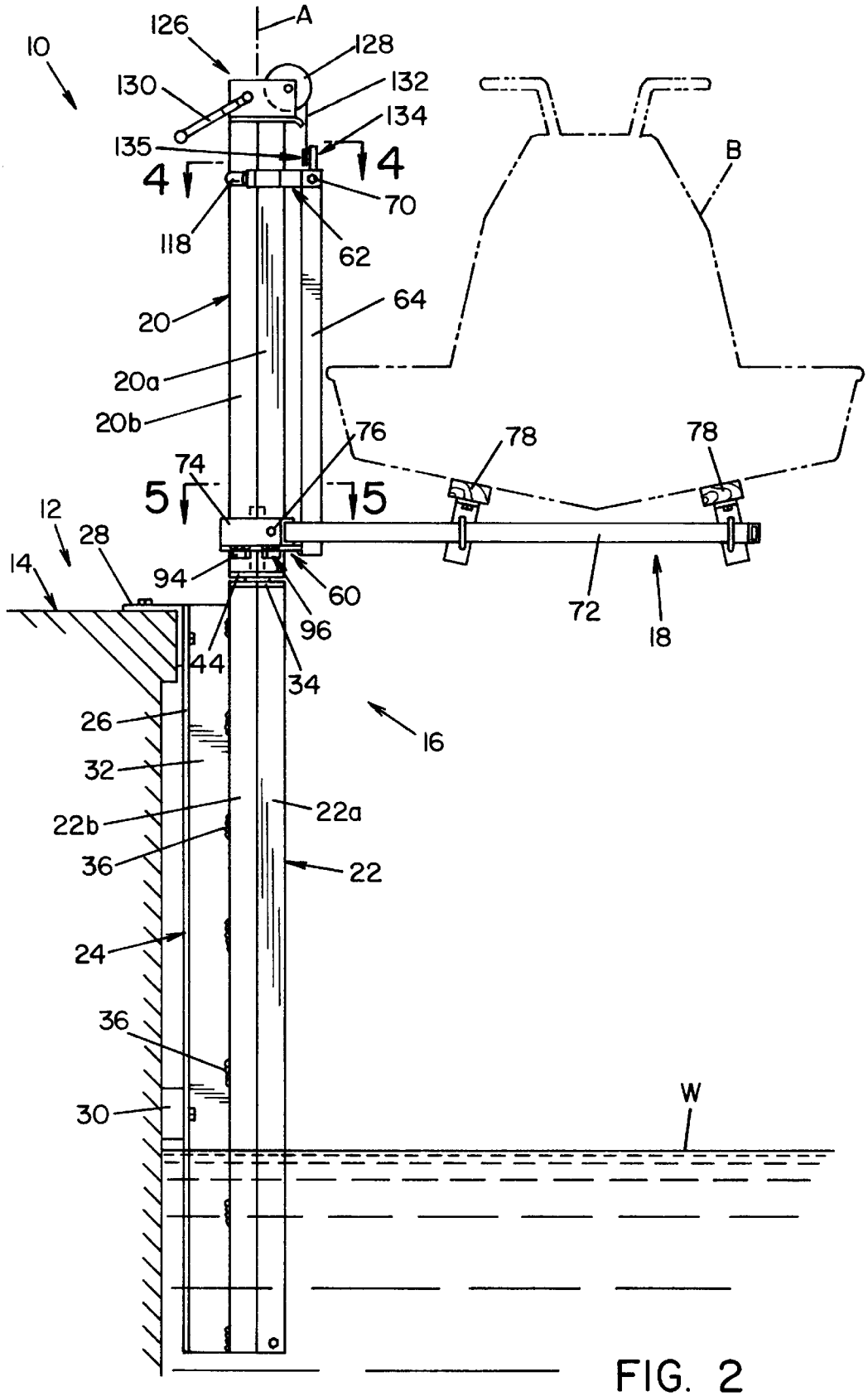
FIG. 2 is a side elevation view of the lifting device shown in FIG. 1 with the cradle elevated above the dock.
Figure 3:
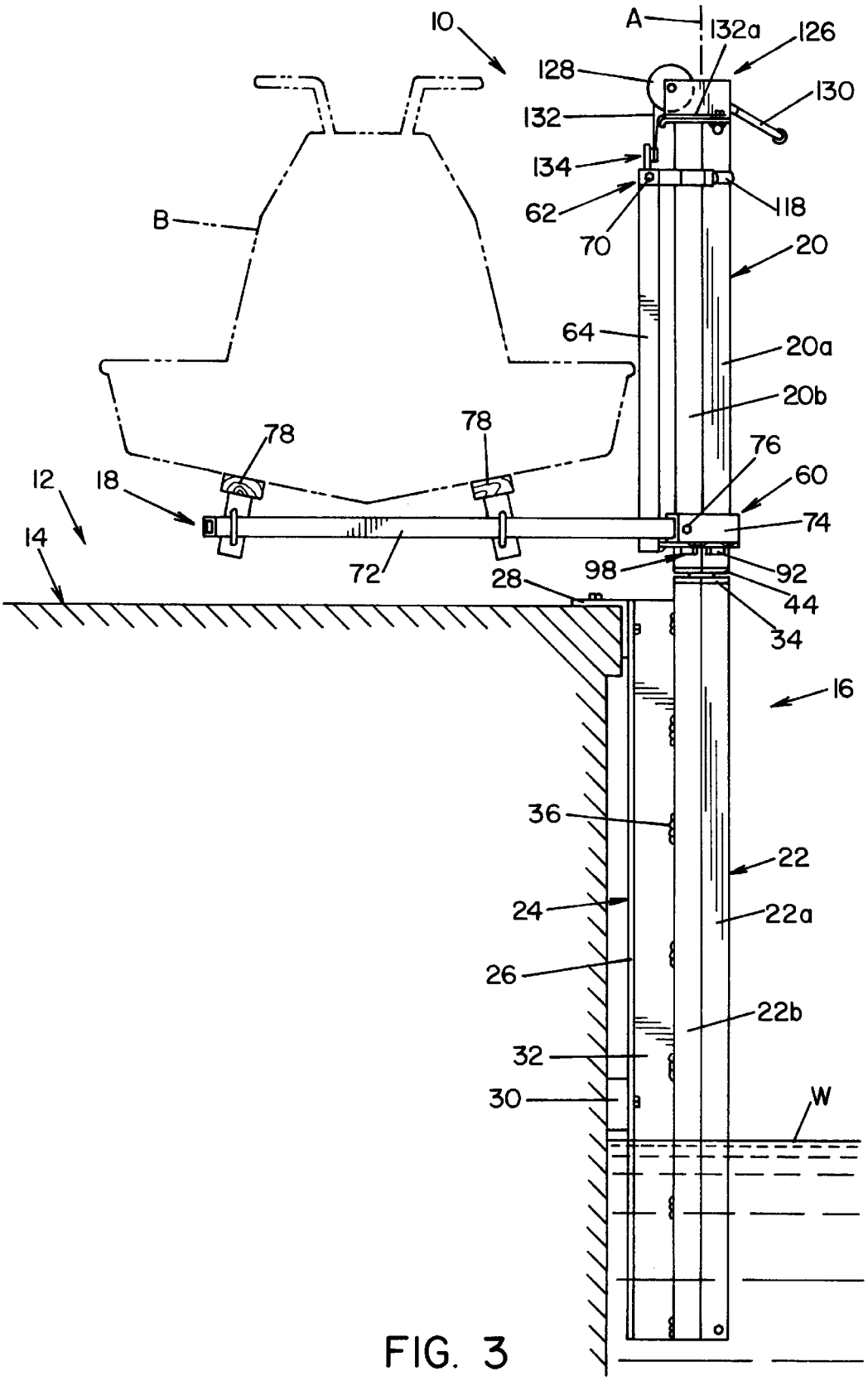
FIG. 3 is a side elevation view similar to FIG. 2 and showing the cradle overlying the dock.

Referring now in greater detail to the drawings, wherein the showings are for the purpose of illustrating preferred embodiments of the invention only and not for the purpose of limiting the invention, FIGS. 1–3 illustrate boat lift apparatus 10 in accordance with the invention mounted on a dock 12 having a deck 14 spaced above water W. Lift apparatus 10 comprises a vertically extending support or track portion 16 having an axis A, and a boat cradle assembly 18 vertically displaceable along track portion 16 as set forth more fully hereinafter. Track portion 16 includes coaxial upper and lower track members 20 and 22, respectively, and lower track member 22 is mounted on dock 12 by a T-shaped stand-off beam 24. Beam 24 extends downwardly from deck 14, and track member 22 has a lower end extending into water W a distance sufficient to accommodate the loading and unloading of a boat relative to cradle 18 when the latter is at the lower end of track portion 16. Beam 24 includes a cross member 26 suitably secured at its upper end to dock 12 such as through use of an angle iron mounting member 28 secured to the edge of deck 14, and suitably secured to the under structure of dock 12 at a location below deck 14 such as through the use of a spacing mounting member 30. Beam 24 further includes a web 32 perpendicular to cross member 26 and providing a stand-off plate by which track portion 16 is supported outwardly adjacent dock 12 as will become apparent hereinafter. In the present embodiment, upper and lower track members 20 and 22 of track portion 16 are comprised of box beams which are rectangular and preferably square in cross section. Accordingly, as will be best appreciated from the showing of upper track member 20 in FIGS. 4 and 5 of the drawing, upper and lower track members 20 and 22 have corresponding pairs of spaced apart parallel sides 20*a* and 22*a* and corresponding pairs of spaced apart parallel sides 20*b* and 22*b*. As will be appreciated from FIG. 6, the upper end of lower track member 22 is closed by a pivot pin plate 34 to be described in greater detail hereinafter whereby, as again will be appreciated from FIGS. 4 and 5, the corner between adjacent sides 22*a* and 22*b* of lower track member 22 are fastened to web 32 of stand-off beam 24 by welds 36. Accordingly, lower track member 22 is rigidly mounted on dock 12.

Figure 5:
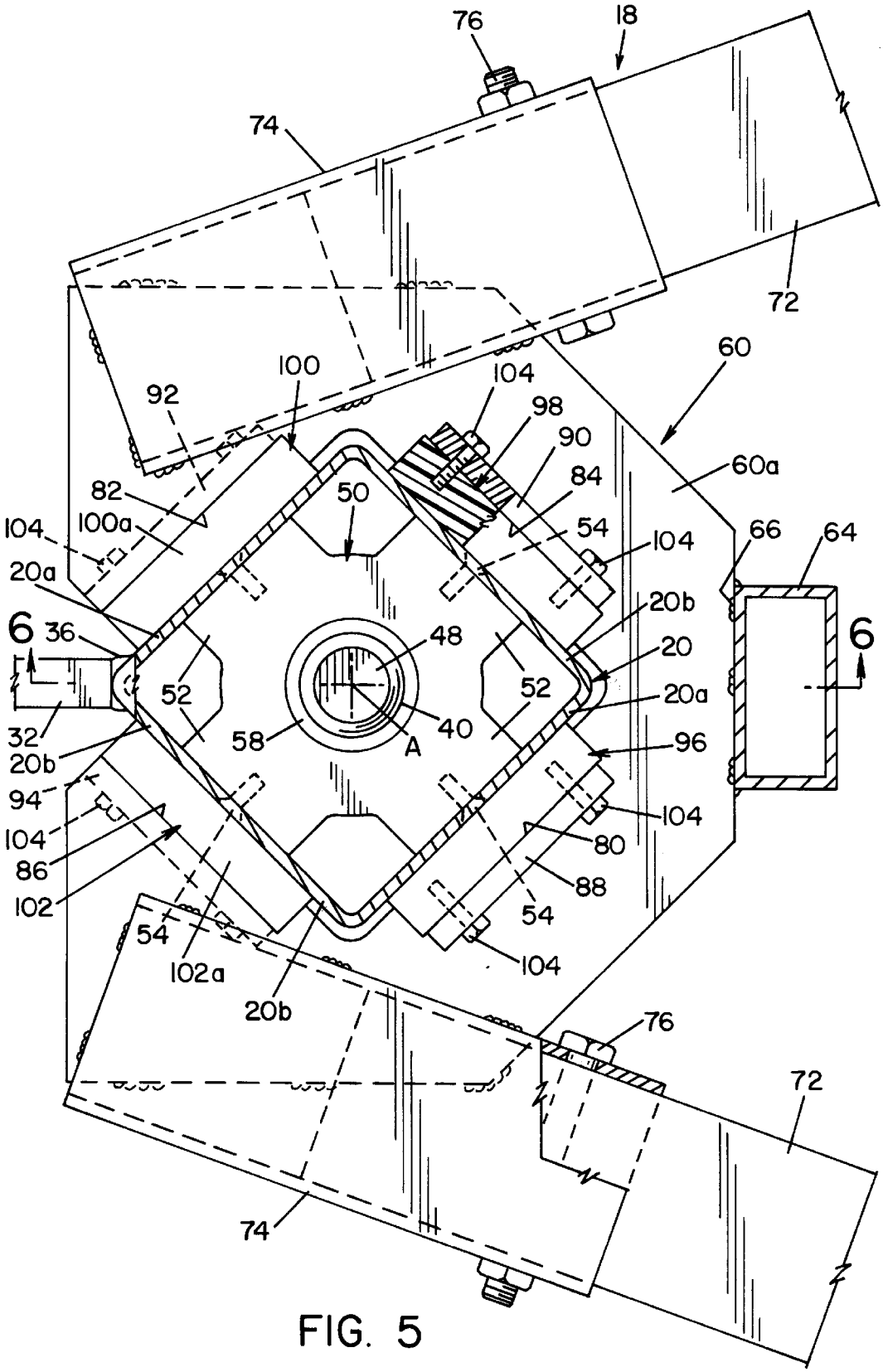
FIG. 5 is a cross-sectional plan view of the track and lower portion of the cradle taken along line 5—5 in FIG. 2.
Figure 6:
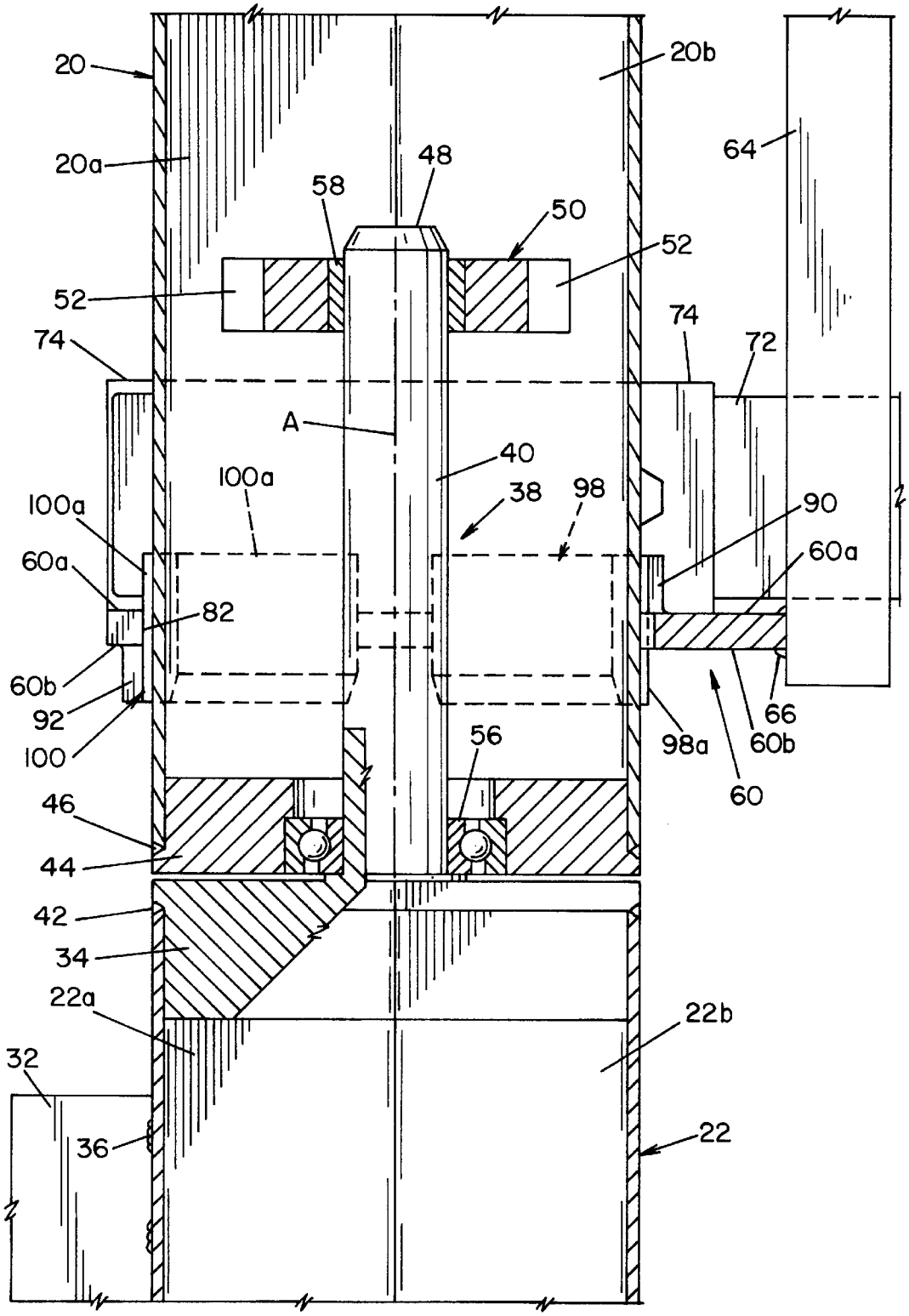
FIG. 6 is a sectional elevation view through the juncture between the upper and lower track portions taken along line 6—6 in FIG. 5.

For the reason which will become apparent hereinafter, upper track member 20 is pivotal about axis A relative to lower track member 22 and, in the embodiment illustrated in FIGS. 1–6 and as is shown in detail in FIG. 6, such pivotal interconnection is achieved by a pivot pin and bearing arrangement 38 at the juncture between upper and lower track members 20 and 22. The pivot pin and bearing arrangement includes a post 40 integral with base plate 34 which is mounted in the upper end of lower track member 22 and secured therein such as by a peripheral weld 42. Post 40 is coaxial with axis A, and the lower end of upper track member 20 is provided with an apertured bearing support plate 44 secured therein such as by a peripheral weld 46. Post 40 extends upwardly through the opening in support plate 44 and has an upper end 48 extending through an opening therefor in an upper bearing support plate 50. As best seen in FIG. 5, support plate 50 has opposed pairs of arms 52 secured to opposed sides 20*a* and 20*b* of upper track member 20 by suitable threaded fasteners 54. A ball bearing unit 56 is interposed between the lower end of post 40 and bearing support plate 44, and a sleeve bearing 58 is interposed between end 48 of post 40 and bearing support plate 50. Accordingly, it will be appreciated that upper track member 20 is pivotal relative to lower track member 22 about axis A. It will be further appreciated that the upper and lower track members are of the same cross-sectional dimensions, whereby such pivotal displacement provides for sequentially moving an opposed pair of the sides of upper track member 20 into vertically co-planar alignment with circumferentially adjacent sides of lower track member 22.

Referring now in particular to FIGS. 1, 2, 4 and 5 of the drawing, cradle 18 of boat lift apparatus 10 comprises lower and upper bearing support members 60 and 62, respectively, vertically spaced apart and interconnected by a tubular cradle frame member 64 having its lower end secured to support member 60 such as by welds 66 and having its upper end received in a recess 68 in support member 62 and secured thereto by a nut and bolt assembly 70. Cradle 18 further includes a pair of tubular cradle arms 72 having inner ends received in a corresponding tubular arm support 74 secured to lower bearing support member 60 such as by welding. The inner ends of arms 72 are secured in supports 74 by a corresponding nut and bolt assembly 76, and the outer ends of arms 72 are provided with cradle slats 78 which are adapted to engage the hull of a boat B to support the latter during lifting and lowering of the boat relative to the water as shown for example in FIG. 2. As will be seen from FIG. 5, lower bearing support 60 extends about track portion 16 and includes an opening corresponding in general to the cross-sectional contour of upper and lower track members 20 and 22. More particularly, the opening is provided with a first pair of opposed inwardly opening U-shaped recesses 80 and 82 and a second pair of opposed inwardly opening U-shaped recesses 84 and 86. The upper side 60*a* of support member 60 is provided with upwardly extending bearing block mounting plates 88 and 90 respectively adjacent to the outer edges of recesses 80 and 84, and the underside 60*b* of support member 60 is provided with downwardly extending bearing block mounting plates 92 and 94 respectively adjacent to the outer edges of recesses 82 and 86. Mounting plates 88, 90, 92 and 94 are secured to support member 60 such as by welding, and bearing blocks 96, 98 100 and 102 are mounted on mounting plates 88, 90, 92 and 94, respectively, by corresponding pairs of threaded fasteners 104. The bearing blocks have planar radially inner surfaces, not designated numerically, for facial sliding engagement with the outer sides of track portion 16 as provided by the walls of track members 20 and 22. Bearing blocks 96 and 98 extend axially downwardly along mounting plates 88 and 90, across recesses 80 and 84 and then downwardly below bottom surface 60*b* of support member 60 to respectively provide lower bearing block portions 96*a* and 98*a*. The latter portions extend below support member 60 a distance generally corresponding to the axial length of mounting plates 88 and 90 and provide bearing block portions which are laterally unsupported relative to support member 60. Similarly, bearing blocks 100 and 102 extend axially upwardly along mounting plates 92 and 94, across recesses 82 and 86 and then upwardly above top surface 60*a* of support member 60 to respectively provide upper bearing block portions 100*a* and 102*a*. The latter portions extend above support member 60 a distance generally the same as that of lower bearing block portions 96*a* and 98*a* and, like the latter, are laterally unsupported relative to support member 60. As will be appreciated from FIGS. 1 and 5, a vertical plane through axis A and parallel to the edge of dock 12 provides track portion 16 of apparatus 10 with inner and outer track surfaces engaged by bearing blocks 96, 98, 100 and 102. Thus, as will be appreciated from FIGS. 5 and 6, the bearing load on the track members from cradle 18 is applied primarily to the outer track surfaces through the lower portions 96*a* and 98*a* of bearing blocks 96 and 98, and primarily to the inner track surfaces through the upper portions 100*a* and 102*a* of bearing blocks 100 and 102. This mounting arrangement advantageously provides for some flexure in the primary areas of loading of the bearing blocks and optimizes the area of facial engagement thereof with the track surfaces and thus facilitates sliding interengagement between the bearing blocks and the sides of the track members. Bearing blocks 96, 98, 100 and 102 are made of a suitable polymeric material such as polyethylene or polytetrafluoroethylene, a high molecular weight polyethylene being preferred because of its impact resistance and its resistance to deterioration in both fresh and salt water environments.

Figure 4:
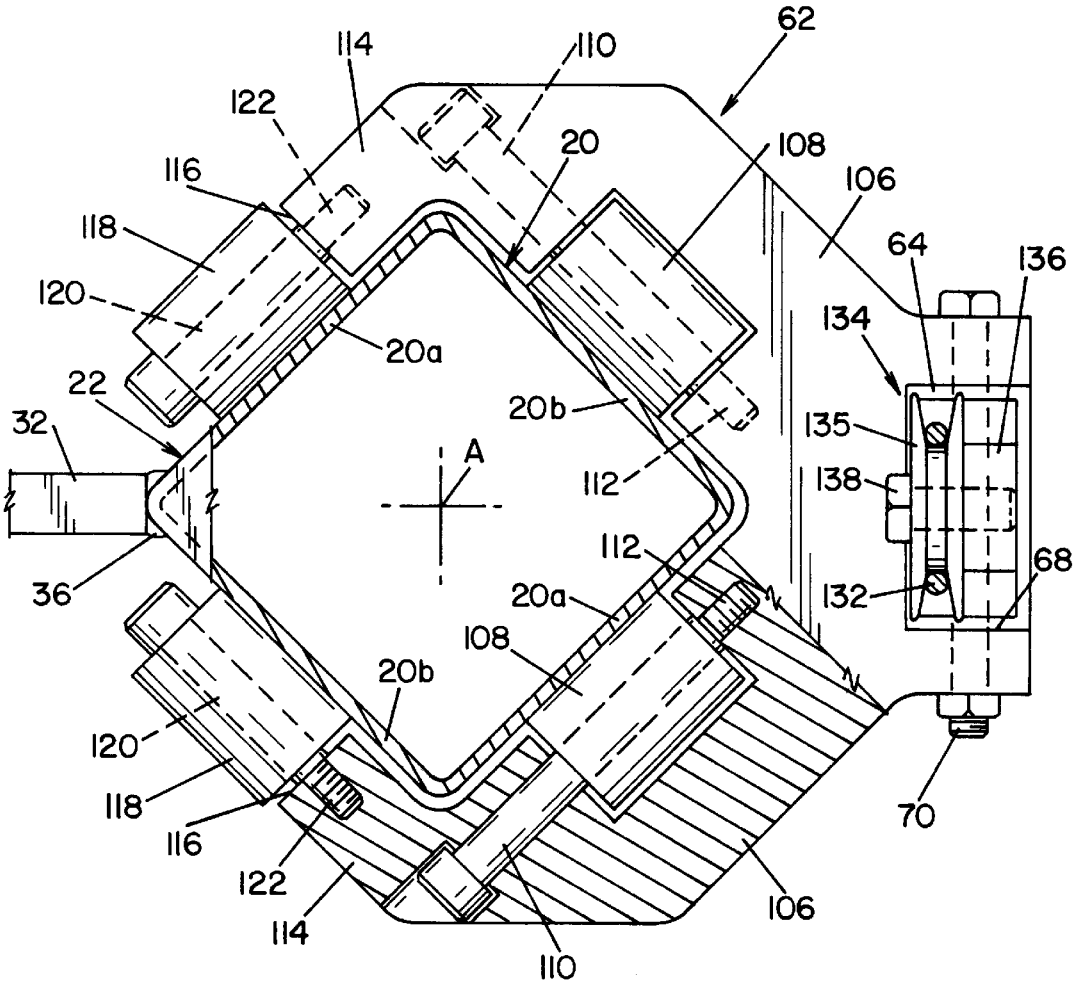
FIG. 4 is a cross-sectional plan view of the support track and upper portion of the cradle taken along line 4—4 in FIG. 2.

As will be seen from FIG. 4, upper bearing support member 62 extends about track portion 16 of the apparatus and includes bearing rolls mounted thereon in opposed pairs for rolling interengagement with the sides of upper and lower track members 20 and 22. More particularly, support member 62 includes outer legs 106 at right angles to one another and having inwardly open U-shaped recesses therein receiving outer bearing rolls 108. Rolls 108 are supported in the corresponding recess for rotation about an axis transverse to axis A and provided by a corresponding axle pin 110 having a threaded end 112 by which the pin is removably mounted in an opening provided therefor in the corresponding leg 106. Support member 62 further includes inner legs 114 extending from the inner ends of legs 106 and at right angles thereto. Legs 114 have inner ends 116 on which bearing rolls 118 are mounted for rotation about axes transverse to axis A and provided by a corresponding axle pin 120 having a threaded end 122 by which the pin is removably mounted on the corresponding leg 114. The pairs of bearing rolls 108 and 118 respectively interengage with the outer and inner track surfaces of track members 20 and 22 to support the elevating and lowering of cradle 18 relative to the upper and lower track members. Similarly, each of the bearing rolls 108 and the opposed bearing roll 118 provide an opposed pair of bearing rolls interengaging with a corresponding opposed pair of sides of track members 20 and 22.

Elevating and lowering of carriage 18 relative to track portion 16 of the apparatus is achieved by a winch mechanism 126 mounted on the top of upper track member 20 for rotation therewith relative to lower track member 22. The winch mechanism includes a cable reel 128 operable through a hand lever 130 and gear box, not shown, to wind and unwind cable 132 relative to the reel. As will be appreciated from FIGS. 1 and 4, upper bearing support member 62 of cradle 18 is provided with a pulley unit 134 comprising a pulley 135 rotatably mounted on a pulley block 136 by means of a bolt 138. The pulley block is mounted in the upper end of tubular cradle support member 64 by nut and bolt assembly 70. Winch cable 132 extends downwardly from reel 128 thence about pulley 135 and upwardly to the upper end of track member 20 where free end 132*a* of the winch cable is anchored. Accordingly, it will be appreciated that the rotation of reel 128 in opposite directions relative to its axis of rotation winds and unwinds cable 132 relative to the reel so as to respectively elevate and lower cradle 18 relative to deck 14 and water W.

When cradle 18 has been elevated from its lower position shown in FIG. 1 to its upper position shown in FIG. 2, the cradle bearing support members have moved from lower track member 22 onto upper track member 20. In this position, upper track member 20 and winch 126 which is rotatable therewith can be rotated about axis A to position cradle 18 over deck 14 of dock 12 as shown in FIG. 3. In this position, a boat B can be loaded onto cradle 18 or unloaded therefrom. Alternatively, boat B may be stored on the cradle in the position overlying and spaced above deck 14, or the cradle can be lowered to rest on deck 14 for storage of the boat. As will be appreciated from the reversal of the positions of the cradle shown in FIGS. 2 and 3 of the drawing, cradle 18 and upper track member 20 can be rotated relative to lower track member 22 to swing the cradle and boat B thereon from the position shown in FIG. 3 to the position shown in FIG. 2 in which the cradle and boat overlie water W. Winch 126 can then be operated to lower cradle 18 along upper track member 20 and thence across the juncture thereof with lower track member 22 and along the latter until the cradle is lowered to the position thereof shown in FIG. 1 in which cradle arms 72 and slats 78 are sufficiently beneath the surface of water W for boat B to float away from the cradle.

Figure 7:
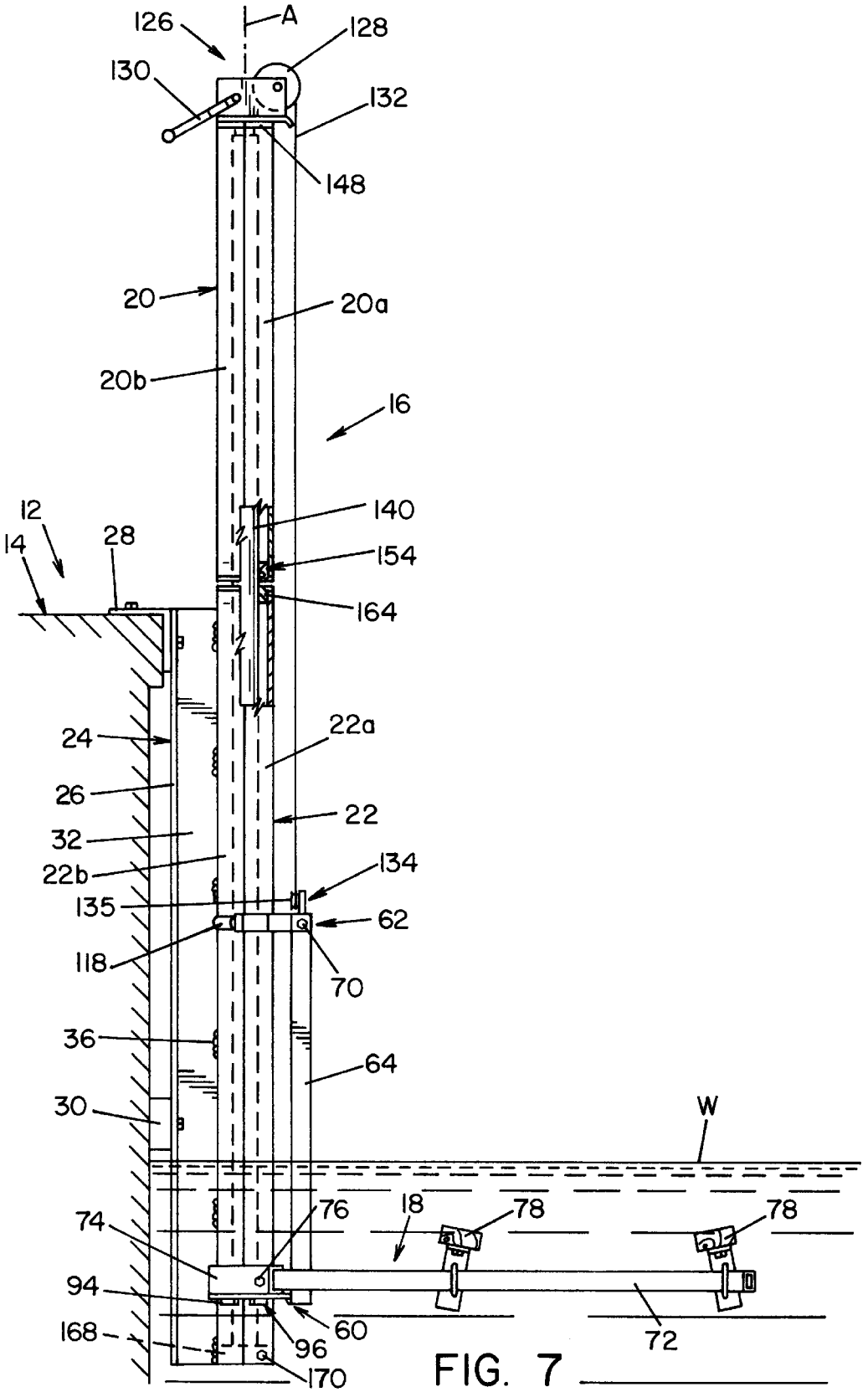
FIG. 7 is a side elevation view of another embodiment of a boat lift in accordance with the invention.
Figure 8:
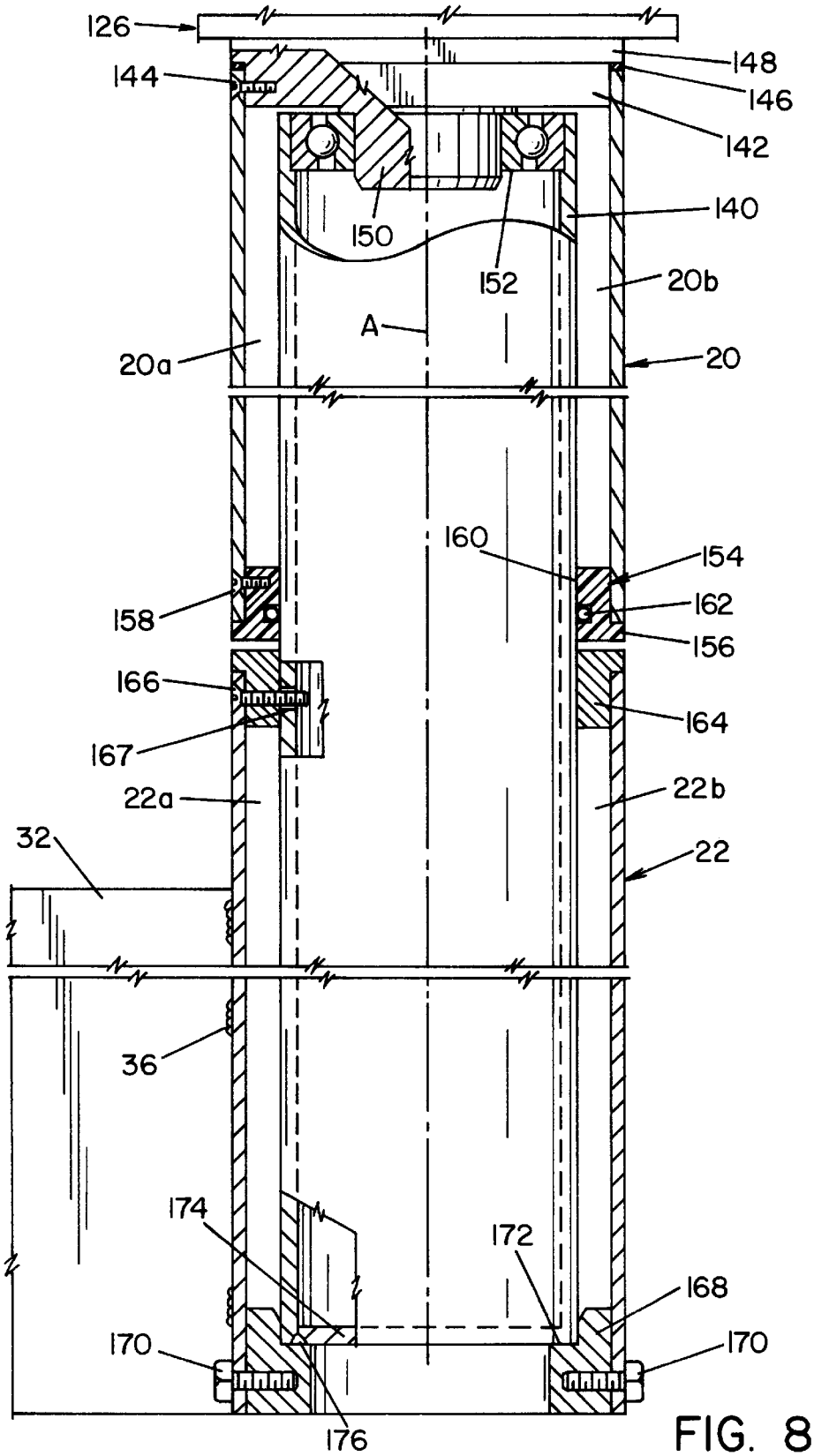
FIG. 8 is a sectional elevation view of the track components of the lift shown in FIG. 7.

The pivot pin and bearing arrangement 38 illustrated and described hereinabove with regard to the pivotal interconnection between the upper and lower track members to facilitate swinging of the cradle and a boat thereon inwardly and outwardly relative to a dock has sufficient structural integrity for supporting pivotal displacement of lightweight boats such as jet skis which weigh from about 230 to 450 lbs. For boats and watercraft heavier than jet skis it is preferred to use a support arrangement such as that shown in FIGS. 7 and 8 of the drawing for supporting the pivotal movement of the upper track member and cradle relative to the lower track member. With the exception of the support structure to be described in this respect, the component parts of the boat lift apparatus shown in FIGS. 7 and 8 are the same as described hereinabove in connection with FIGS. 1–6, whereby like numerals appear in FIGS. 7 and 8 for such parts. The modification of the support arrangement shown in FIGS. 7 and 8 provides an inner tubular post member 140 extending continuously from the upper end of upper track member 20 to the lower end of lower track member 22. As best seen in FIG. 8, the upper end of upper track member 20 is provided with a bearing pin base plate 142 secured in place by a plurality of threaded fasteners 144 with an annular seal 146 interposed between track member 20 and flange 148 on base plate 142. As will be appreciated from FIG. 7, winch 126 is mounted on the upper end of flange 148. A pin 150 is integral with base plate 142 and extends downwardly therefrom into the upper end of post 140, and a ball bearing unit 152 is interposed between pin 150 and post 140. The lower end of track member 20 is provided with an annular bearing member 154 which, as will be appreciated from FIG. 4 for example, has a square outer periphery corresponding in contour with the inner periphery of the lower end of track member 20. Bearing member 154 has a peripheral flange 156 overlying the lower edge of track member 20 and is secured in place within the lower end of the track member by a plurality of threaded fasteners 158, only one of which is visible in FIG. 8. Bearing member 154 has a circular inner surface 160 engaging the outer surface of post 140 and, preferably, bearing member 154 is provided with an annular inwardly open recess receiving an O-ring seal 162 to seal against the ingress of moisture and contaminants across bearing member 154. The upper end of lower track member 22 is provided with an annular support collar 164 which is retained in place on the upper end of track member 22 by threaded fasteners 166, only one of which is visible in FIG. 8. Preferably, fasteners 166 extend through openings 167 therefor in post 140 for the purpose set forth hereinafter. The lower end of lower track member 22 is provided with an annular support collar 168 secured therein by a plurality of threaded fasteners 170, and the upper end of collar 168 is provided with a circular shoulder 172 against which the lower end of post 140 rests. Preferably, the lower end of post 140 is closed and sealed such as by an end wall 174 received in the lower end of the post and sealed therein such as by a peripheral weld 176. Accordingly, it will be appreciated that the interior of post 140 is sealed and bearing unit 152 thus protected from moisture by seal member 146 and 162 and weld 176.

As will be appreciated from the foregoing description, when cradle 18 is elevated onto upper track member 20 through the operation of winch 126, upper track member 20 and the cradle thereon are pivotal about post 140 so as to position the cradle over deck 14. Such pivotal displacement of upper track member 20 relative to post 140 is facilitated by bearing unit 152 and by sliding engagement between post 140 and bearing sleeve 154. It will be further appreciated, especially if the cradle is carrying a boat of considerable weight that such turning movement of the cradle and upper track member 20 relative to post 140 imposes torque on the post tending to twist the latter about axis A. Such twisting is restrained by fasteners 166 extending through the wall of post 140. As will likewise be appreciated from FIGS. 7 and 8, the coextensive relationship between post 140 and the upper and lower track members provides considerable structural integrity against bending of the track portion of the lift apparatus as a result of the cantilever loading of the latter.

Figure 9:
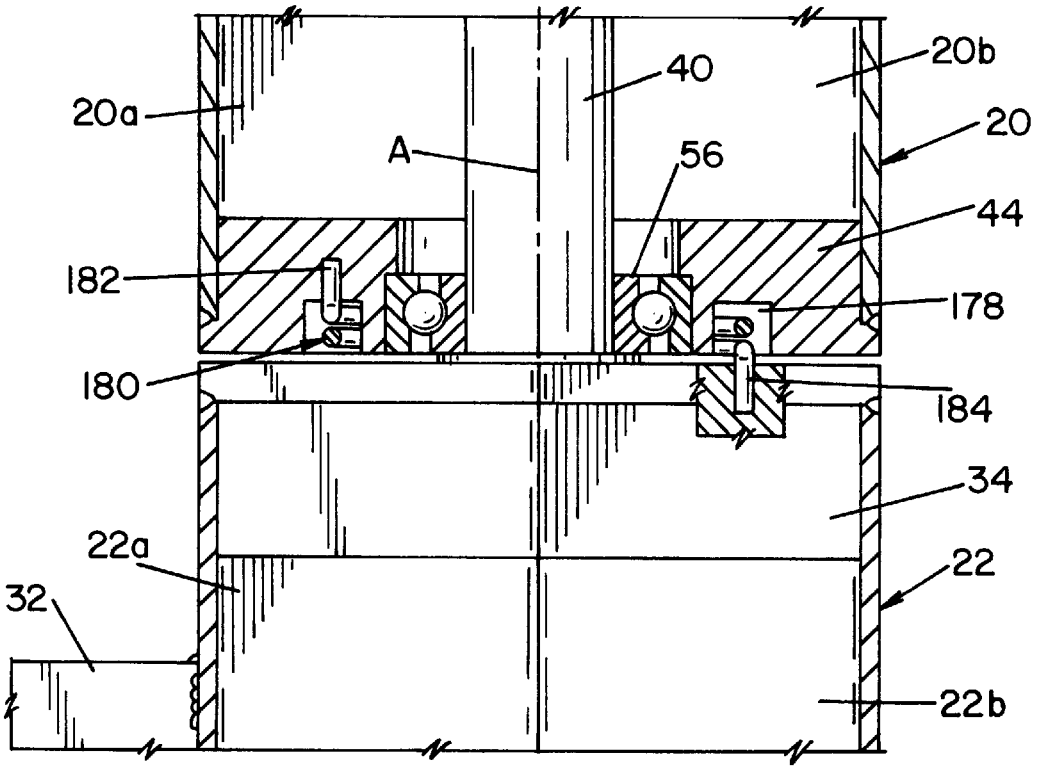
FIG. 9 is a sectional elevation view of a centering spring arrangement between the upper and lower track portions of a lift in accordance with the invention.
Figure 10:
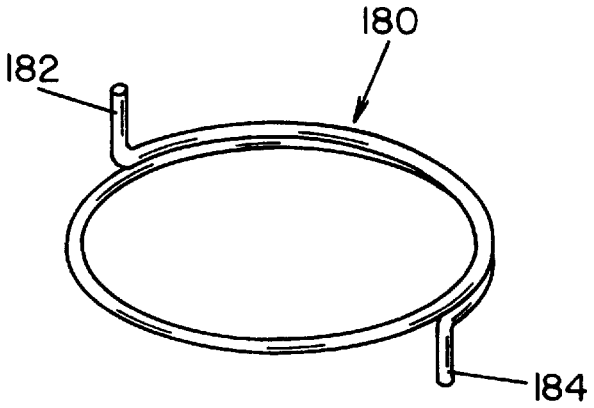
FIG. 10 is a perspective view of the centering spring shown in FIG. 9.
Figure 11:
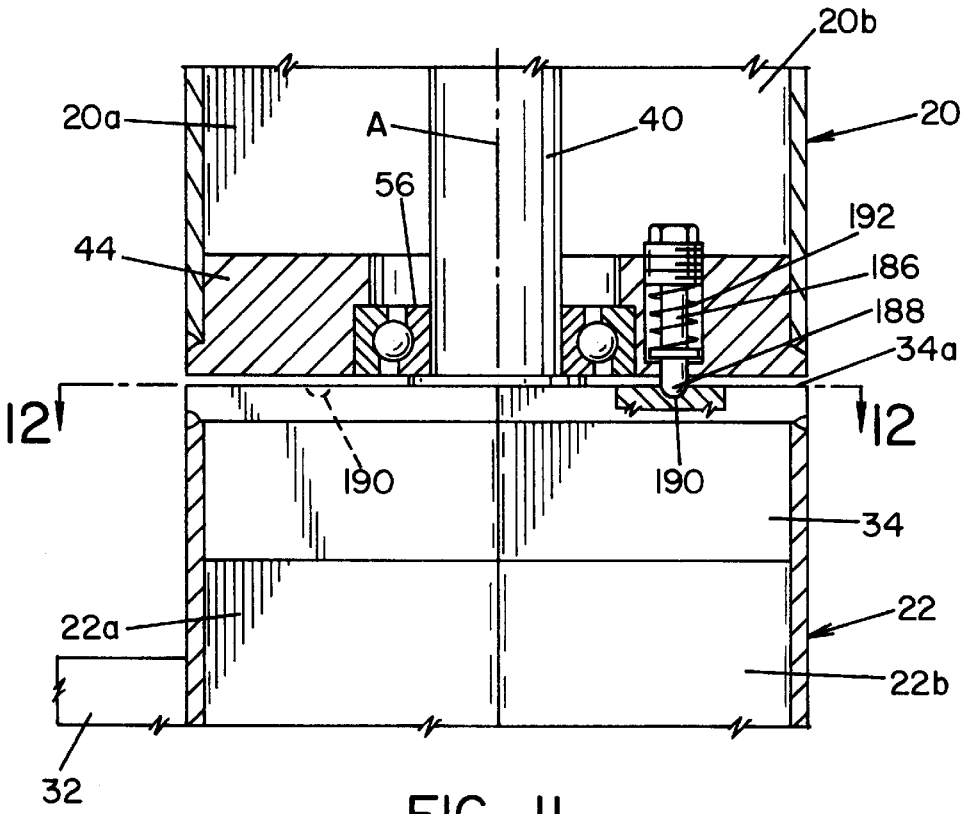
FIG. 11 is a cross-sectional elevation view of a detent arrangement between the upper and lower track portions of lift according to the invention.
Figure 12:
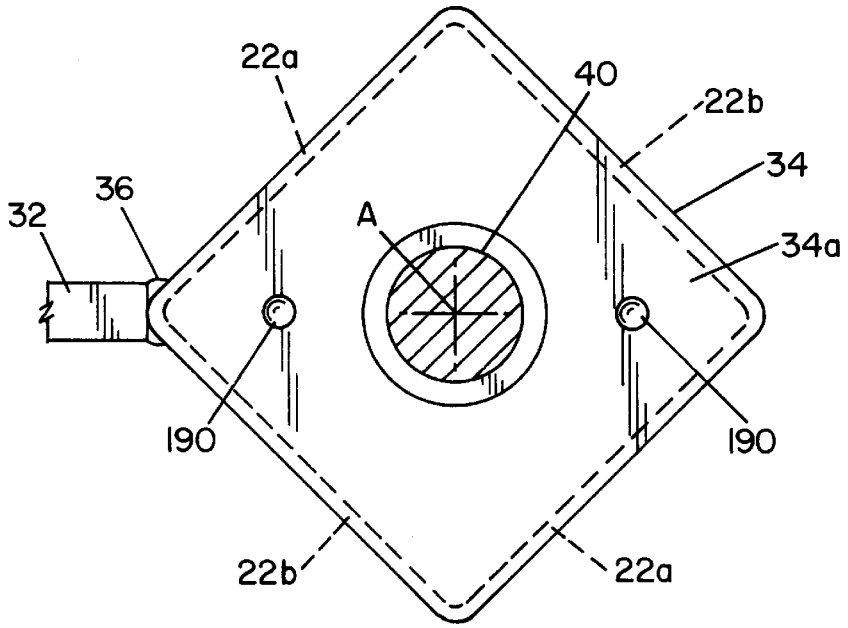
FIG. 12 is a plan view of the detent arrangement taken along line 12—12 in FIG. 11.

In connection with swinging upper track member 20 about axis A relative to lower track member 22, it is advantageous to provide the lift apparatus with a keeper arrangement by which the upper and lower track members are aligned so that lowering of the cradle from the upper track member to the lower track member takes place across the juncture therebetween without interference which could damage the bearing components on the cradle. Moreover, such a keeper arrangement advantageously stabilizes the upper track member against unintended and/or undesired rotation relative to the lower track member such as can occur during a boat elevating or lowering operation as a result of rotational forces imposed on the upper track member in response to rotating the winch crank. FIGS. 9 and 10 illustrate a centering spring arrangement for these purposes which is shown in connection with the embodiment of the boat lift apparatus illustrated in FIGS. 1–6 of the drawing.

More particularly in this respect, bearing support plate 44 in the lower end of upper track member 20 is provided with an annular recess 178 which receives a coiled centering spring 180. Spring 180 has one end 182 extending axially into a bore therefor in bearing support plate 44 and the opposite end 184 extending in the axially opposite direction and into a bore therefor in post base plate 34 in the upper end of lower track member 22. It will be appreciated that the mounting and orientation of spring 180 relative to plates 44 and 34 is such that spring 180 in its neutral position provides for coplanar alignment between the axially adjacent sides of the upper and lower track members which provides for cradle 18 to be elevated and lowered along track portion 16 between the positions of the cradle shown in FIGS. 1 and 2 of the drawing. Accordingly, it will likewise be appreciated that rotation of upper track member 20 in opposite directions about axis A is against the bias of spring 180 tending to return the spring to its neutral position.

Another keeper arrangement for achieving the desired alignment between the upper and lower track members is shown in FIGS. 11 and 12, again in connection with the apparatus illustrated in FIGS. 1–6 of the drawing. In this embodiment of the keeper arrangement, bearing support plate 44 on the lower end of upper track member 20 is provided with an axially displaceable plunger 186 having a rounded lower end or nose 188 for seating engagement in one of a pair of recesses 190 in upper surface 34*a* of post base plate 34 on the upper end of lower track member 22. A spring 192 biases plunger 186 downwardly and, in response to pivotal displacement of upper track member 20 in either direction about axis A, recess 190 engages against nose 188 of plunger 186 to displace the plunger upwardly against the bias of spring 192. Recesses 190 are on diametrically opposite sides of the axis A and equally spaced therefrom, whereby it will be appreciated that pivotal displacement of upper track member 20 180° from the position shown in FIG. 11 causes nose 188 of plunger 186 to be displaced upwardly from recess 190 shown in FIG. 11 and to then ride along upper surface 34*a* until reaching recess 190 shown on the left-hand side of axis A in FIG. 12. When nose 188 reaches the latter recess, spring 192 biases the plunger downwardly for the nose to enter the recess and thus releasably retain upper track member 20 in its reoriented position relative to lower track member 22. While it is preferred to provide two recesses 190 as shown, it will be appreciated that a single recess could be provided for releasably holding the cradle in a desired position. It will be further appreciated that the plunger and recess arrangement can be reversed for the plunger to be on base plate 34 and the recesses in support plate 44. As will be appreciated from the previous description herein, the interengaging relationship between nose 188 of plunger 186 and the two recesses 190 provides the desired coplanar relationship between the opposed pairs of sides of the upper and lower track members with the boat cradle either positioned over the deck or laterally outwardly thereof over the water. While the keeper arrangements are shown in FIGS. 9–12 in connection with the lift apparatus illustrated in FIGS. 1–6 it will be appreciated that similar keeper arrangements could be provided on the apparatus shown in FIGS. 7 and 8.

While considerable emphasis has been placed herein on the structures and structural interrelationships between the component parts of the preferred embodiments of the boat lift apparatus, it will be appreciated that other embodiments can be made and that many changes can be made in the preferred embodiments without departing from the principals of the invention. Accordingly, it is to be distinctly understood that the foregoing descriptive matter is to be interpreted merely as illustrative of the invention and not as a limitation.

Having thus described the invention, it is claimed:

1. Boat lift apparatus comprising, track member means for vertical mounting on a dock structure, said track member means having a vertical axis and including a lower track portion and an upper track portion, cradle means supported on said track member means for vertical displacement relative thereto between said lower and upper portions thereof, said cradle means including axially spaced apart upper and lower bearing support members, bearing rolls on said upper support member, bearing blocks on said lower support member, said rolls and blocks interengaging with said track member means for guiding and supporting said displacement of said cradle means, and means on said upper track portion for vertically displacing said cradle means relative to said track member means.

2. Boat lift apparatus comprising, track member means for vertical mounting on a dock structure, said track member means having a vertical axis and including a lower track portion and an upper track portion, cradle means supported on said track member means for vertical displacement relative thereto between said lower and upper portions thereof, said cradle means including axially spaced apart upper and lower bearing support members, bearing rolls on said upper support member, bearing blocks on said lower support member, said rolls and blocks interengaging with said track member means for guiding and supporting said displacement of said cradle means, means on said upper track portion for vertically displacing said cradle means relative to said track member means, and means interconnecting said lower and upper track portions for said upper portion to pivot about said axis for turning said cradle means about said axis when said cradle means is on said upper track portion.

3. Lift apparatus according to claim 1, wherein said bearing rolls include first and second pairs of diametrically opposed rolls in rolling contact with said track member means.

4. Lift apparatus according to claim 1, wherein said bearing blocks include first and second pairs of diametrically opposed blocks slidably engaging said track member means.

5. Lift apparatus according to claim 1, wherein said bearing rolls include a plurality of pairs of diametrically opposed rolls in rolling contact with said track member means, and said bearing blocks include a plurality of pairs of diametrically opposed blocks slidably engaging said track member means.

6. Lift apparatus according to claim 2, wherein said means interconnecting said lower and upper track portions includes a post extending vertically between said lower and upper portions and fixed to one of said portions, and bearing means between said post and the other of said portions.

7. Lift apparatus according to claim 6, wherein said post is fixed to said lower track portion.

8. Boat lift apparatus comprising, track member means for vertical mounting on a dock structure, said track member means having a vertical axis and including a lower track portion and an upper track portion, cradle means supported on said track member means for vertical displacement relative thereto between said lower and upper portions thereof, said cradle means including axially spaced apart upper and lower bearing support members, bearing rolls on said upper support member, bearing blocks on said lower support member, said rolls and blocks interengaging with said track member means for guiding and supporting said displacement of said cradle means, means on said upper track portion for vertically displacing said cradle means relative to said track member means, said upper track portion being pivotal about said axis between first and second positions, and means biasing said upper portion to said first position.

9. Boat lift apparatus comprising, track member means for vertical mounting on a dock structure, said track member means having a vertical axis and including a lower track portion and an upper track portion, cradle means supported on said track member means for vertical displacement relative thereto between said lower and upper portions thereof, said cradle means including axially spaced apart upper and lower bearing support members, bearing rolls on said upper support member bearing blocks on said lower support member said rolls and blocks interengaging with said track member means for guiding and supporting said displacement of said cradle means, means on said upper track portion for vertically displacing said cradle means relative to said track member means, said upper track portion being pivotal about said axis between first and second positions, and means releasably interengaging said upper and lower track portions in at least one of said positions of said upper portion.

10. Lift apparatus according to claim 1, wherein said track member means is tubular and of rectangular contour transverse to said axis.

11. Lift apparatus according to claim 10, wherein said track member means has opposed pairs of parallel spaced apart sides, said lower bearing support member having opposed pairs of bearing supports each facing an opposed pair of said sides, and said bearing blocks being between each of said sides and a corresponding bearing support on said lower support member.

12. Lift apparatus according to claim 11, wherein said bearing rolls are rotatable about axes transverse to said axis of said track member means and in rolling engagement with a corresponding side of said track member means.

13. Lift apparatus according to claim 11, wherein each of said bearing blocks includes a planar bearing surface in sliding engagement with a corresponding side of said track member means.

14. Boat lift apparatus comprising, track member means for vertical mounting on a dock structure, said track member means having a vertical axis and including a lower track portion and an upper track portion, cradle means supported on said track member means for vertical displacement relative thereto between said lower and upper portions thereof, said cradle means including axially spaced apart upper and lower bearing support members, bearing rolls on said upper support member, bearing blocks on said lower support member, said rolls and blocks interengaging with said track member means for guiding and supporting said displacement of said cradle means, means on said upper track portion for vertically displacing said cradle means relative to said track member means, said track member means having laterally outer and inner track surfaces with respect to a vertical plane through said axis, said lower bearing support member being transverse to said axis and having top and bottom sides, said bearing blocks including first bearing blocks engaging said outer track surfaces and second bearing blocks engaging said inner track surfaces, said first bearing blocks including a laterally outwardly unsupported portion extending below said bottom side, and said second bearing blocks including a laterally inwardly unsupported portion extending above said top side.

15. Lift apparatus according to claim 14, wherein said laterally outer and inner track surfaces respectively include a pair of planar outer track surfaces at right angles to one another and a pair of planar inner track surfaces at right angles to one another, said first bearing blocks including a first pair of bearing blocks each engaging a different one of said pair of outer track surfaces, and said second bearing blocks including a second pair of bearing blocks each engaging a different one of said pair of inner track surfaces.

16. Boat lift apparatus comprising, a lower vertical tubular track member having an axis, an upper tubular track member coaxial with said lower member, means interconnecting said lower and upper track members for said upper member to pivot relative to said lower member about said axis, each of said lower and upper track members having opposed pairs of axially extending track surfaces, a cradle mounted for vertical movement in opposite directions along said track surfaces of said lower and upper track members, said cradle having an upper end including bearing rolls and a lower end including bearing blocks, said bearing rolls and bearing blocks interengaging with said track surfaces and supporting said cradle for axial displacement therealong and against rotation relative thereto, and means on said upper track member for moving said cradle in opposite directions along said track surfaces between first and second positions in which said cradle is respectively on said lower track member and on said upper track member, whereby said cradle in said second position is pivotal with said upper track member about said axis.

17. Lift apparatus according to claim 16, wherein said bearing rolls include pairs of opposed rolls interengaging with said opposed pairs of track surfaces and mounted on said cradle for rotation about axes transverse to said track member axis.

18. Lift apparatus according to claim 16, wherein said bearing blocks include opposed pairs of bearing blocks interengaging with said opposed pairs of track surfaces and having planar bearing surfaces slidably engaging said track surfaces.

19. Lift apparatus according to claim 16, wherein said lower and upper track members have axially opposed ends, post means mounted in said lower track member and extending across said ends into said upper track member, and bearing means interengaging said post means and said upper track member for said upper track member to be rotatable about said axis.

20. Lift apparatus according to claim 19, wherein said axially opposed ends include the upper end of said lower track member and the lower end of said upper track member, said post means including a post having a base mounted in said upper end of said lower member and extending into said lower end of said upper member, said post having an inner end axially spaced from said base, said bearing means including first bearing means mounted in said lower end of said upper track member and interengaging with said post adjacent said base, and second bearing means mounted in said upper track member and interengaging with said post adjacent said inner end thereof.

21. Lift apparatus according to claim 19, wherein said axially opposed ends include the upper end of said lower track member and the lower end of said upper track member, said lower track member having a bottom end and said upper track member having a top end, said post means including a tubular post extending inside said upper and lower track members between said top and bottom ends, said bearing means including first and second bearing means between said upper track member and said tubular post respectively adjacent said lower end of said upper track member and said top end of said upper track member.

22. Lift apparatus according to claim 21, wherein said tubular post has an end adjacent said top end of said upper track member, said second bearing means including a pin on said top end of said upper track member extending into said end of said tubular post, and annular bearing means radially interposed between said pin and said end of said tubular post.

23. Lift apparatus according to claim 22, and sealing means between said first bearing means and said tubular post.

24. Lift apparatus according to claim 16, wherein each said lower and upper track member is rectangular in cross section and has opposed pairs of parallel walls providing said track surfaces, said cradle including axially spaced apart upper and lower bearing support members, said bearing rolls being mounted on said upper support member in opposed pairs facing a corresponding opposed pair of said walls, and said bearing blocks being mounted on said lower support member in opposed pairs facing a corresponding opposed pair of said walls.

25. Lift apparatus according to claim 24, wherein said lower and upper track members have axially opposed ends, post means mounted in said lower track member and extending across said ends into said upper track member, and bearing means interengaging said post means and said upper track member for said upper track member to be rotatable about said axis.

26. Lift apparatus according to claim 25, wherein said axially opposed ends include the upper end of said lower track member and the lower end of said upper track member, said post means including a post having a base mounted in said upper end of said lower member and extending into said lower end of said upper member, said post having an inner end axially spaced from said base, said bearing means including first bearing means mounted in said lower end of said upper track member and interengaging with said post adjacent said base, and second bearing means mounted in said upper track member and interengaging with said post adjacent said inner end thereof.

27. Lift apparatus according to claim 25, wherein said axially opposed ends include the upper end of said lower track member and the lower end of said upper track member, said lower track member having a bottom end and said upper track member having a top end, said post means including a tubular post extending inside said upper and lower track members between said top and bottom ends, said bearing means including first and second bearing means between said upper track member and said tubular post respectively adjacent said lower end of said upper track member and said top end of said upper track member.

28. Lift apparatus according to claim 27, wherein said tubular post has an end adjacent said top end of said upper track member, said second bearing means including a pin on said top end of said upper track member extending into said end of said tubular post, and an annular bearing radially interposed between said pin and said end of said tubular post.

29. Lift apparatus according to claim 30, and sealing means between said first bearing means and said tubular post.

30. Lift apparatus according to claim 16, wherein said lower and upper track members have adjacent axially opposed ends, and keeper means interengaging said opposed ends for maintaining a given angular orientation between said lower and upper track members.

31. Lift apparatus according to claim 30, wherein said keeper means includes coil spring means coaxial with said axis and having opposite spring ends each fixed to a different one of said opposed ends.

32. Lift apparatus according to claim 30, wherein said keeper means includes spring biased plunger means on one of said opposed ends and recess means on the other of said opposed ends for releasable interengagement with said plunger means.

33. Lift apparatus according to claim 16, wherein said lower and upper track members have laterally outer and inner track walls with respect to a vertical plane through said axis, a bearing support member on said lower end of said cradle transverse to said axis and having top and bottom sides, said bearing blocks including first bearing blocks engaging said outer track walls and second bearing blocks engaging said inner track walls, said first bearing blocks including a laterally outwardly unsupported portion extending below said bottom side, and said second bearing blocks including a laterally inwardly unsupported portion extending above said top side.

34. Lift apparatus according to claim 33, wherein said laterally outer and inner track walls respectively include a pair of planar outer track walls at right angles to one another and a pair of planar inner track walls at right angels to one another, said first bearing blocks including a first pair of bearing blocks each engaging a different one of said pair of outer track walls, and said second bearing blocks including a second pair of bearing blocks each engaging a different one of said pair of inner track walls.

* * * * *